US005931095A

United States Patent [19]

Platsch

[11] Patent Number: 5,931,095

[45] Date of Patent: Aug. 3, 1999

[54] METHOD AND APPARATUS FOR DUSTING PRODUCTS, ESPECIALLY PRINTED PRODUCTS

[76] Inventor: Hans Georg Platsch, Kupferstr. 40, D-70565 Stuttgart, Germany

[21] Appl. No.: 08/974,943

[22] Filed: Nov. 20, 1997

[30] Foreign Application Priority Data

Nov. 21, 1996 [DE] Germany ..... 196 48 227

[51] Int. Cl.[6] ..... B41F 35/00

[52] U.S. Cl. ..... 101/424.2; 101/483

[58] Field of Search ..... 101/424.2, 483, 101/416.1, 419, 420, 424.1

[56] References Cited

U.S. PATENT DOCUMENTS

| | | | |
|---|---|---|---|
| 2,148,739 | 2/1939 | Friess | 101/416.1 |
| 2,613,603 | 10/1952 | Ireton | 101/416.1 |
| 3,053,180 | 9/1962 | Doyle | 101/416.1 |
| 3,167,012 | 1/1965 | Claybourn | 101/416.1 |
| 3,275,196 | 9/1966 | Warczak | 101/416.1 |
| 4,294,556 | 10/1981 | Rix | 101/424.1 |
| 5,443,005 | 8/1995 | Platsch | 101/424.2 |
| 5,537,925 | 7/1996 | Secor et al. | 101/424.1 |

*Primary Examiner*—Edgar Burr
*Assistant Examiner*—Anthony H. Nguyen

[57] ABSTRACT

To dust printed products, it is proposed to arrange a powder-gas mixture delivery nozzle arrangement in a flow of transport gas that has a speed component opposite to the direction in which the products to be dusted are conveyed.

29 Claims, 6 Drawing Sheets

METHOD AND APPARATUS FOR DUSTING PRODUCTS, ESPECIALLY PRINTED PRODUCTS

BACKGROUND OF THE INVENTION

1. Technical Field

The invention relates to a method for dusting products and to an apparatus for dusting products.

2. Background Information

U.S. Pat. No. 5,090,626 discloses powder delivery nozzles distributed transverse to the direction in which the printed products are conveyed, which together produce a cloud of powder-gas mixture, through which the products are moved.

If the products are not resistant to bending, for example, printed sheets, the jets of powder-gas mixture discharged by the delivery nozzles produce a transverse sag in the product. This is a disadvantage for a smooth guidance of the products. The intense pressure of the jets of powder-gas mixture on the surface of the products to be dusted also produces unstable flow conditions. A further disadvantage of the known arrangement is that the reflected jets of air carry a relatively large proportion of the powder away from the surface of the products to be dusted.

SUMMARY OF THE INVENTION

The present invention is intended to specify a method and an apparatus for dusting products, which ensure improved efficiency during transfer of powder from the flow of powder-gas mixture onto the products.

In the method according to the invention the portions of the flow of powder-gas mixture that are reflected from the surface of the printed products are re-supplied to the product surface by a flow of transport gas. This transport gas flow is directed towards the product surfaces to just brush past the same, and is substantially laminar. In the case of the method according to the invention, a greater efficiency is therefore achieved in the transfer of powder to the product surfaces.

Advantageous developments of the invention are specified in the subsidiary claims.

The flow of powder gas mixture and the conveying plane of the products can form substantially a right angle with one another. By this method a very intense flow of powder-gas mixture onto the product surfaces is achieved.

The angular setting between the carrier gas flow and the conveying plane of the products can be between 5 and 60, preferably between 10 and 45, even more preferably between 15 and 25. This is advantageous with regard to good laminar flow conditions for the transport gas and with regard to an extensive re-application to the product surface of powder particles moving away from the product surface.

The magnitude of the flow of transport gas can be adjusted in dependence on the conveying speed of the products. This allows compensation of a current of air generated by the moved products and their conveying device, which is entrained in the conveying direction.

The overlap region between the flow of powder gas mixture and the flow of transport gas can be adjacent to the conveying plane of the products. This is advantageous with regard to good laminar flow conditions between gas delivery device and gas suction device.

A flow of barrier gas having a speed component tangential to the conveying plane of the products can be directed towards the surface of the product, the flow of barrier gas being against the flow of transport gas and lying opposite the flow of transport gas relative to the flow of the powder gas mixture. This is advantageous with regard to keeping escape of powder particles from the dusting region at a low level, or eliminating such an escape completely.

The flow of transport gas may have a tangential component against the conveying direction of the products which is greater than the flow of barrier gas which has a tangential component in the same direction as the direction in which the products are conveyed. Alternatively, the flow of transport gas can have a tangential component running in the direction in which the products are conveyed and is smaller than the flow of barrier gas, which has a tangential component against the direction in which the products are conveyed. This has the advantage that the powder particles that have not clung to the product surface after a first contact are re-directed towards the product surface again. This can be effected by a stream of transport gas flowing against the direction in which the products are being conveyed, or by a gentle flow of transport gas conveyed in the same direction as the products.

The transport gas and, if applicable, barrier gas can be extracted by suction from a region which, viewed in the direction in which the products conveyed, lies downstream of the overlap region of the transport gas flow and the powder-gas mixture flow. This is advantageous with regard to avoiding escape of unused powder particles from the dusting zone.

According to the present invention there is also provided an apparatus for dusting products, having at least one delivery device for powder-gas mixture, which extends transverse to the direction in which the products are conveyed and is connected to a generator for the powder-gas mixture, a delivery device for transport gas, which extends in the width direction transverse to the direction in which the products are conveyed and by which a flow of transport gas having a component tangential to the conveying plane of the products is generated, and a housing surrounding the powder-gas mixture delivery device, which housing extends between the transport gas delivery device and a suction device,, the width direction of the suction device running transverse to the direction in which the products are conveyed and the suction device being connected to an extractor fan, and in that the working plane of the transport gas delivery device and the working plane of the suction device having a component tangential to the conveying surface for the products.

The working planes of the transport gas delivery device and the suction device can have substantially opposite and equal angular settings (w) to the product conveying surface.

In the working plane pre-set by the powder-gas mixture delivery device delivery ends of delivery nozzles for powder gas mixture can have a smaller spacing from the product conveying surface than from the working plane of the transport gas delivery device. This is advantageous with regard to greatest possible transfer of powder to the product surfaces.

The spaced powder-gas mixture delivery nozzles of the powder-gas mixture delivery device can be carried by a powder-gas mixture distribution pipe so that a rake like structure is obtained, the ends of the tines of the rake being formed by the ends of the delivery nozzles and being adjacent to the product conveying plane, whereas the powder-gas mixture distribution pipe lies remote from the product conveying plane. This has the advantage that the different delivery nozzles for the powder-gas mixture do not significantly disturb the flow of transport gas.

The axis of the powder-gas mixture delivery nozzles of the apparatus can stand perpendicular to the product conveying plane. This is advantageous with regard to an initial contact of the powder-gas mixture with the product surface that is as concentrated as possible.

In addition to the powder-gas delivery nozzles of the powder gas mixture delivery device being carried by a powder-gas mixture distribution pipe to obtain a rake like structure, the powder gas mixture distribution pipe may be arranged behind the hub portions of fan wheels when viewed in the flow direction of the transport gas, the hub portions of the fan wheels being arranged side by side in a transverse direction in a transport gas delivery duct. This has the advantage that the powder-gas mixture distributor pipe lies in the lee of hub portions of fan wheels, and thus does not significantly disturb the flow of transport gas; the flow paths from the powder-gas mixture distributor pipe to the delivery ends of the delivery nozzles are nevertheless only short.

Between the suction device and the conveying plane of the products of the apparatus a barrier air device can be arranged, the width direction of the barrier air device can run transverse to the direction in which the products are conveyed and which is exposed to the action of a fan. This allows a careful fluidic guidance of the flow of transport gas to the suction device.

The walls of the housing which connects the transport gas delivery device to the suction device can be made at least partly from microporous material and their rear side can be in connection with compressed air chambers. This serves to avoid powder deposits on the inside of the housing extending between the delivery device and the suction device.

The apparatus can have a guide member which defines the conveying plane or is adjacent thereto, in front of which the products pass and which extends between the transport gas delivery device and the suction device. This has the advantage that powder-gas mixture does not escape into the surroundings, even when the delivery of powder-gas mixture is not controlled to be strictly synchronous with the passage of products to be dusted past the delivery nozzles for powder-gas mixture.

The guide member of the apparatus can be provided, at least at its upstream end, viewed in the direction in which the products are conveyed, preferably also at its downstream end, with a guide ramp for product carriers. This is advantageous with regard to a self-centering of product grippers as the products enter the dusting apparatus.

At the upstream end of the guide member an air delivery device can be provided which generates a current of sealing air directed towards the transport gas delivery device and flowing substantially parallel to the guide member and extending over the width of the suction device.

This is advantageous with regard to a good dynamic sealing of the dusting apparatus with respect to its surroundings.

There can be provided at the downstream end of the guide member an air delivery device which generates a current of sealing air directed towards the suction device, flowing substantially parallel to the guide member and extending over the width of the transport gas delivery device. This has the same advantage as above.

Different fans of the apparatus can be controlled by a control unit, in each case according to the speed at which the products are conveyed, for which purpose the control unit can be connected on an input side to a speed sensor which cooperates with the product conveying device. Thus, the flow of transport gas and sealing air is adapted automatically to the speed at which the products are being conveyed.

The transport gas delivery device, and, if applicable, the barrier gas delivery device, can comprise a delivery pipe to which transport gas, respectively barrier gas, can be applied from both ends. This is advantageous with regard to a uniform supply of transport gas respectively barrier gas in a direction transverse to the direction in which the products are conveyed.

The suction device can comprise a suction pipe which is connected at both ends to an extractor fan. This ensures a uniform suction of gas that contains unused powder particles in a direction transverse to the direction in which the products are conveyed.

The suction device of the apparatus can comprise a suction pipe transverse to the direction in which then products are conveyed, the pipe being connected by way of a powder separating unit, especially a powder separating cyclone, to the inlet of an extractor fan; and, the suction pipe can comprise a controllable supplementary air opening by means of which it can be connected to the ambient atmosphere. This is advantageous in so far as the amount of transport gas and, if desired, the amount of barrier gas, emerging towards the products can be adjusted in accordance with the desired conveying conditions for the products. Thus, for example in the case of printed products, one must take into account the fact that they can be manufactured from paper of different grammage, and, in order to have consistent conveying conditions in the region of the dusting apparatus, printed products of high grammage need to be treated with somewhat less transport gas and barrier gas than products of low grammage, if one wishes to ensure that the position of the products in front of the powder-gas mixture delivery device will be the same despite a different weight of the products. Powder-separating devices, for example powder separating cyclones, operate most effectively when the entire gas flow through them does not change. The above development allows the flow of transport gas and, if applicable, the flow of barrier gas, to be varied, but by control of the supplementary air opening in the inverse direction allows the overall flow of gas that is supplied to the separating unit to be kept constant.

The supplementary air opening can be provided symmetrically with respect to the middle of the suction pipe in a wall region of the suction pipe lining remote from the conveying plane of the products. This has the advantage that the air opening does not create suction effects that differ over the width of the dusted products.

The symmetrically provided supplementary air opening can be controlled by two slide valves constrained to move in the longitudinal direction of the pipe symmetrically with respect to the middle of the suction pipe or by a slide valve movable transverse to the longitudinal direction of the pipe. This is advantageous with regard to symmetrical flow conditions inside the suction pipe.

The apparatus can have a slotted pipe used to deliver or extract gas which has an opening extending substantially over its entire axial length, and a slide valve can be arranged so as to be circumferentially displaceable on the outer surface of the delivery pipe. This also ensures uniform flow conditions in the transverse direction of the products.

BRIEF DESCRIPTION OF THE DRAWINGS

The invention is explained in greater detail hereinafter with reference to an exemplary embodiment and with reference to the drawings, in which.

DESCRIPTION OF PREFERRED EMBODIMENTS

Figure 1:
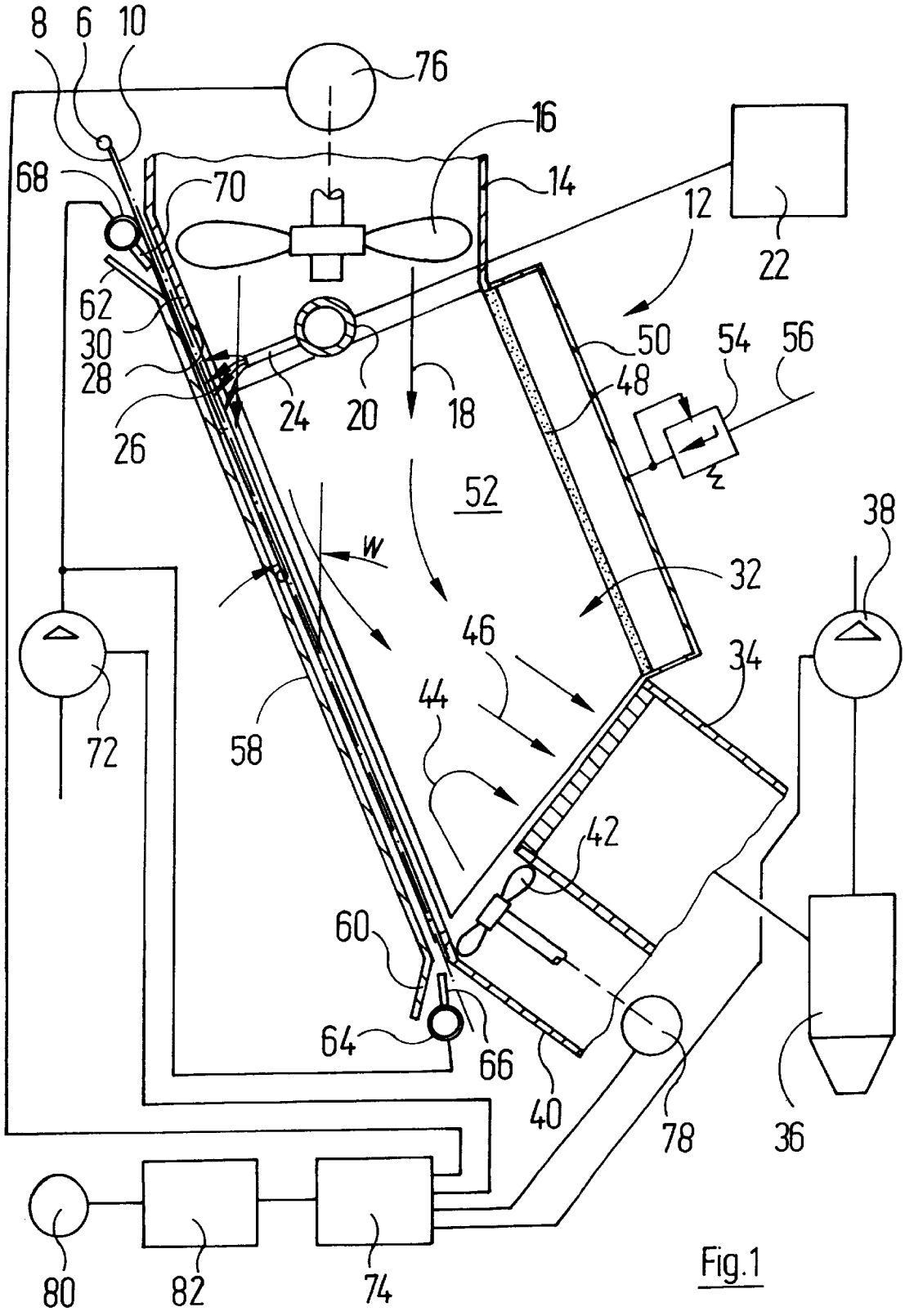
FIG. 1 shows a longitudinal section through an apparatus for dusting printed products and a block diagram of supply and removal devices for this apparatus.

In the drawing, the reference number 10 denotes a conveying plane illustrated by a dot-dash line, along which printed products 8 are moved by a conveying device, not illustrated, from bottom right to top left. This conveying device comprises in known manner a pair of spaced endless conveying means that carry the two ends of rodshaped sheet grippers 6, which grip the leading end of a printed sheet each time.

A dusting box denoted generally by the reference number 12 is arranged above the obliquely ascending conveying plane 10. The dusting box has a delivery duct 14 in which, perpendicular to the plane of projection, a plurality of fan wheels 16 lying one behind the other is arranged. These together generate a flow of transport gas indicated by arrows 18.

A powder-gas mixture distributor pipe 20, which is connected to the output of a powder-gas mixture generator 22, is arranged in extension of the hubs of the fan wheels 16. Details of the construction of such powder-gas mixture generators can be inferred from U.S. Pat. No. 5,090,626, to which reference will be made in this connection.

The powder-gas mixture distributor pipe 20 carries, perpendicular to the plane of projection and lying in alignment one behind the other, a plurality of delivery nozzles 24 for powder-gas mixture, which are tubular and extend into the vicinity of the conveying plane 10. The delivery nozzles 24 and the powder-gas mixture distributor pipe 20 thus together form a rake-like structure through which the current of transport gas 18 flows.

Under operating conditions, each delivery nozzle 24 delivers a puff of powder-gas mixture 26, which comprises particles of powder distributed in air. The puffs of powder-gas mixture 26 are directed towards the surface of the printed sheets. The powder-gas mixture containing fewer powder particles and flowing away from the product surface is carried, in the drawing, downwards tangentially along the conveying plane 10 by the current of transport gas 18, so that further powder particles are continuously conveyed towards the tacky surface of the printed sheets to be dusted.

To ensure such an effective transfer of powder particles to the printed sheets, the delivery duct 14 for the current of transport gas 16 is inclined at an angle w to the conveying plane 10, which in the embodiment being considered is about 220. The height of the delivery duct 14 is matched corresponding to the angle w to the length of a window 28, which is provided in a wall 30, facing towards the conveying plane 10, of a housing 32.

At its upstream end, the housing 32 carries a suction duct 34, which is connected by way of a powder-separating cyclone 36 to an inlet of a suction fan 38. The axis of the suction duct 34 forms an angle with the conveying plane 10 that is the same size as the angle w but has the opposite sign.

Below the suction duct 34 a barrier air duct 40 is arranged, in which, perpendicular to the plane of projection, a plurality of fan wheels 42 is arranged. These generate a current of barrier air 44, which diverts the mixture of transport gas and depleted powder-gas mixture into the suction duct 34 being inclined with respect to the conveying plane 10, as indicated at 46.

The wall area of the housing 32 remote from the conveying plane 10 is formed by a microsporous panel 48, behind which there is a compressed air chamber 50. Similarly, the wall of the housing 32 lying in the drawing beneath the plane of projection is formed by a panel 52, which has likewise been manufactured from microsporous material and behind which there is also a compressed air chamber. The limiting wall of the housing 32 to be imagined above the plane of projection is of analogous construction. The compressed air chamber 50 and the other compressed air chambers are connected to a compressed air line 56 by way of a pressure regulator 54. In this way, air emerges from the surfaces of the panels 48, 52 constantly at a low speed, which prevents powder particles from settling on the panels 48, 52.

A little way behind the conveying plane 10 there is arranged a guide plate 58, which has larger dimensions than the window 28 and at the upstream end is provided with an intake ramp 60 and at the downstream end is provided with an outlet ramp 62. These ramps cooperate with the gripper rods for the printed sheets.

Arranged in the wedge-shaped gap lying between the intake ramp 60 and the conveying plane 10 is a compressed air distributor pipe 64, which has a plurality of compressed air delivery nozzles 66 arranged in succession perpendicular to the plane of projection and directed into the wedge-shaped gap.

Similarly, a compressed air distributor pipe 68 having axially spaced compressed air delivery nozzles 70 is provided in the wedge-shaped space bounded by the conveying plane 10 and the outlet ramp 62.

The guide plate 58 serves, firstly, as support for the printed sheets against the powder-gas mixture and transport gas flowing onto them. Furthermore, the guide plate 58 serves as a cover for the window 28, at which powder-gas mixture and transport gas are held back and deflected back to the suction duct 34 when no printed sheet is present at the window 28, or only a part of a printed sheet is present there.

The compressed air distributor pipes 64 and 70 are connected to the output of a fan 72, which is controlled by a fan control unit 74. The latter furthermore controls the extractor fan 38 and drive motors 76, 78, that drive the fan wheels 16 and 42 respectively.

The fan control unit 74 operates in dependence on the output signal of a speed sensor 80, which generates a signal proportional to the conveying speed of the gripper rods for the printed sheets. The sensor may be a tachometer generator that co-operates with a chain wheel over which a chain carrying the gripper rods for the printed sheets runs. The fan control unit 74 operates, roughly speaking, so that it increases the output of the different fans when the conveying speed of the products is increased, and conversely reduces the output of the fans when the products are being moved more slowly. In order to_allow this speed control to deviate from a linear correlation between the conveying speed of the products and the output of the fans, between the output of the speed sensor 80 and the input of the fan control unit 74 a characteristics circuit or; original modifying circuit working in accordance with predetermined characteristics 82 is inserted, which, for example for low conveying speeds, can set a constant low base output of the fans and for high conveying speeds can define a constant top fan output, these regions being connected by a proportional zone. It is obvious that the outputs of the different fans are as a whole different: the amount of barrier air delivered by the barrier air shaft 40 is clearly smaller than the amount of transport air delivered by the delivery duct 14, and the amount of sealing air delivered by the compressed air distributor pipes 64, 68 is again clearly smaller than the amount of barrier air.

Figure 2:
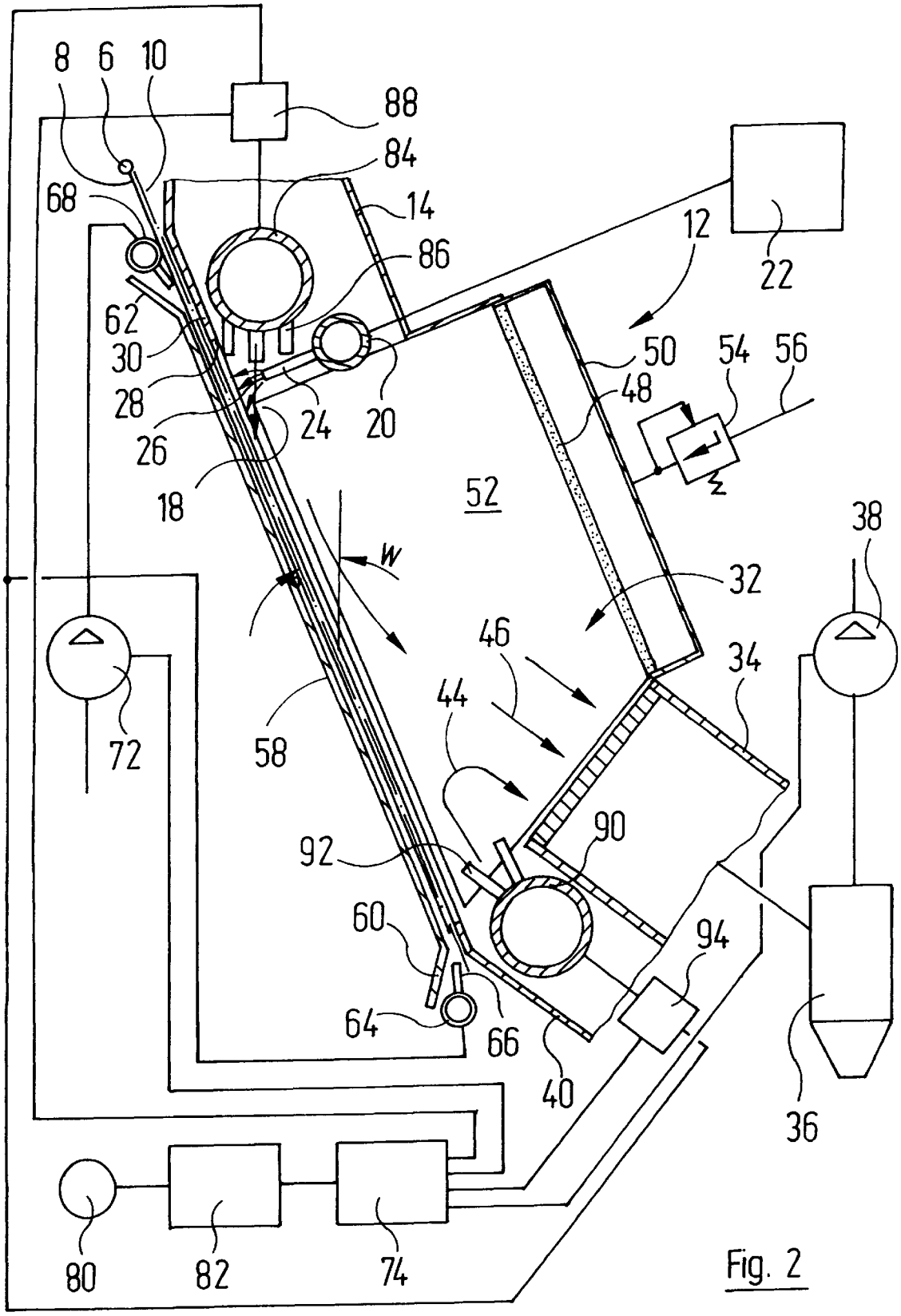
FIG. 2 shows a sectional view similar to that of FIG. 1, illustrating a modified dusting apparatus.

In the modified exemplary embodiment according to FIG. 2, components of the apparatus equivalent in function to those that have already been described above with reference to FIG. 1 have been provided with the same reference numbers again. These components are also not described again below.

In place of the series of fan wheels 16 arranged in the delivery shaft 14, there is now arranged in the delivery shaft 14, upstream of the delivery nozzles 24 for powder-gas mixture, a delivery pipe 84 for transport gas, which has a plurality of delivery nozzles 86 for transport air set at an angle w to the conveying surface 10. The air jets emerging from the delivery nozzles 86 together form an air current 18 adjacent to the delivery ends of the delivery nozzles 24 for powder-gas mixture.

The two ends of the delivery pipe 84 are connected by way of a controllable current regulator 88 to the output of the fan 72. Control of the current regulator 88 is effected by the fan control unit 74 analogously to the control of the drive motor 76 of FIG. 1.

Similarly, in place of the set of fan wheels 42, a delivery pipe 90 for barrier air is provided, which has delivery nozzles 92 for barrier air inclined on average at the angle w to the conveying plane 10.

The delivery pipe 90 is connected at its two ends by way of a current regulator 94 to the output of the fan 72, the current regulator 94 being controlled by the fan control unit 74 in the same way as the drive motor 78 in the exemplary embodiment shown in FIG. 1.

Figure 3:
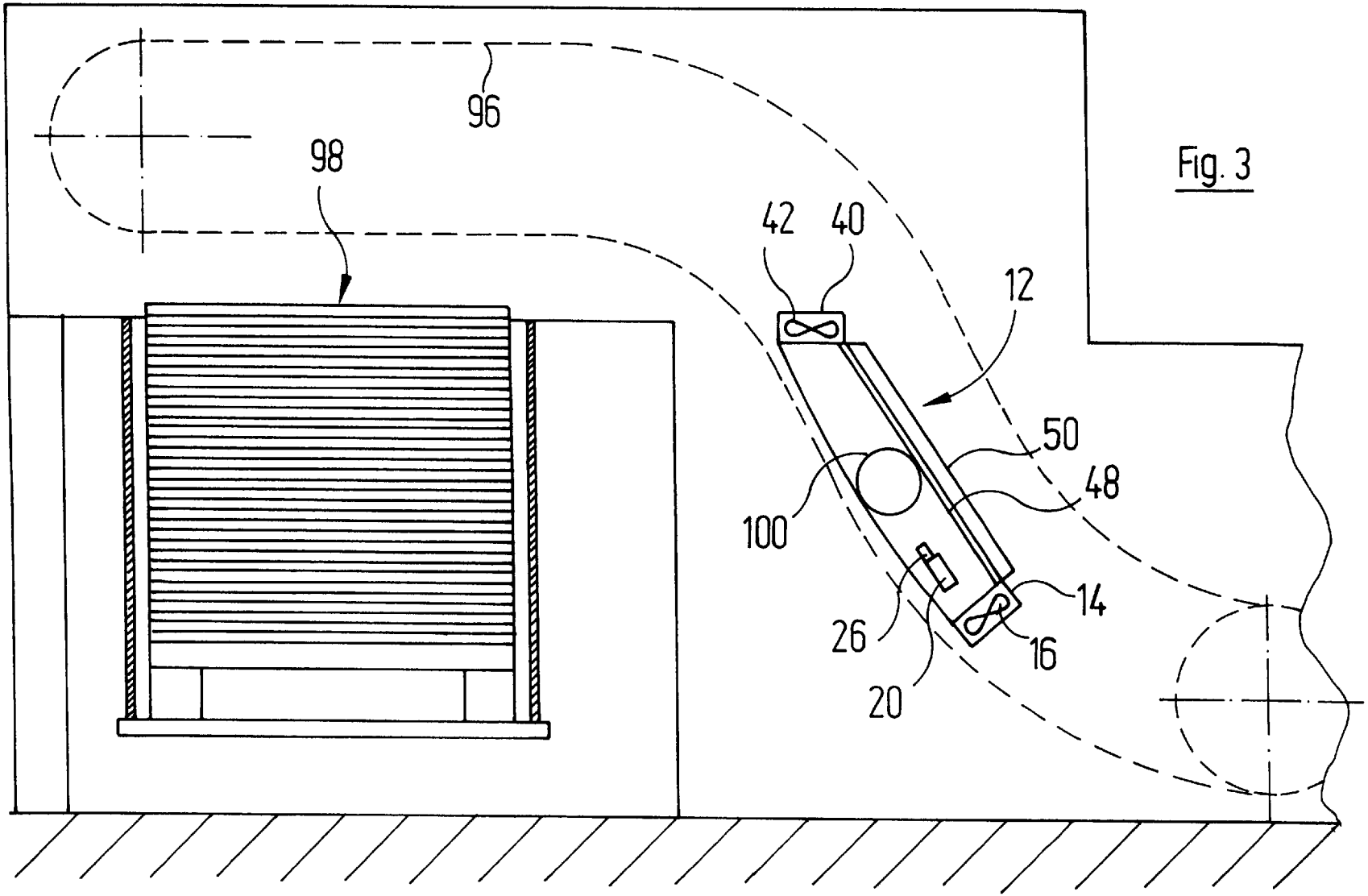
FIG. 3 shows a diagrammatic view of the discharge side section of a multicolour printing press, in which a further modified dusting apparatus is illustrated diagrammatically.

In FIG. 3, the broken line 96 shows the path of the chains of the printed sheet-conveying device that carry the grippers 6. The reference number 98 denotes a printed sheet delivery station. In the ascending portion of the conveying path between the exit of the multicolour printing press and the end of the printed sheet conveying path, which lies above the sheet delivery station 98, there is a dusting box 12. Components in the latter corresponding in function to the components already described above with reference to FIGS. 1 and 2 have again been provided with the same reference numerals.

The fan wheels 16 generating the transport gas are now arranged upstream of the powder-gas mixture distributor pipe 20, whilst the fan wheels 42 generating the barrier gas flow lie downstream of the dusting region. The fan wheels are so designed and operated that the flow of transport gas 1 8 is smaller than the flow of barrier air 44; by virtue of the described arrangement the flow of transport gas moves with a component parallel to the direction in which the products are being conveyed whilst the flow of barrier gas has a component opposite to the direction in which the products are being conveyed.

Between the powder-gas mixture distributor pipe 20 and the barrier air shaft 40 a large diameter suction pipe 100 is provided. This is provided at its surface line lying furthest downstream with a plurality of suction openings 102, which are reproduced in FIGS. 4 and 5 tilted upwards through 90" for the sake of clarity, in reality therefore lie in the planes of projection of FIGS. 4 and 5, namely in those Figures at the left-hand side respectively the upper side of the suction pipe 100.

In its region remote from the conveying plane 10, the suction pipe 100 has a central supplementary air opening 104, which can be opened to a greater or lesser extent by two oppositely symmetrically moved slide valves 106. Displacement of the slide valves 106 can be effected, for example, by a transverse operating rod 108.

Figure 4:
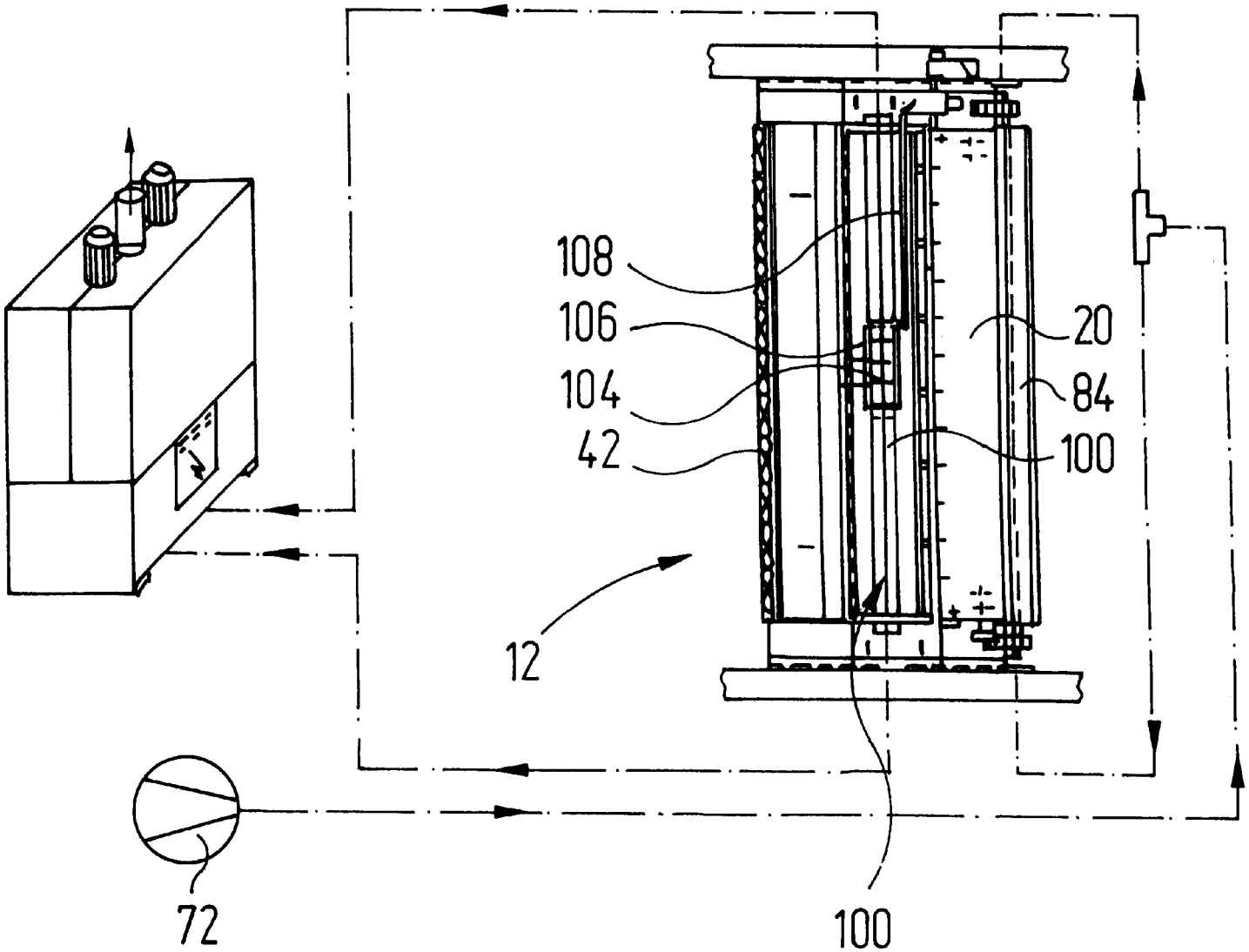
FIG. 4 is a plan view of the dusting apparatus of FIG. 3 on an enlarged scale after removal of a cover plate, supply and removal devices additionally being shown.
Figure 5:
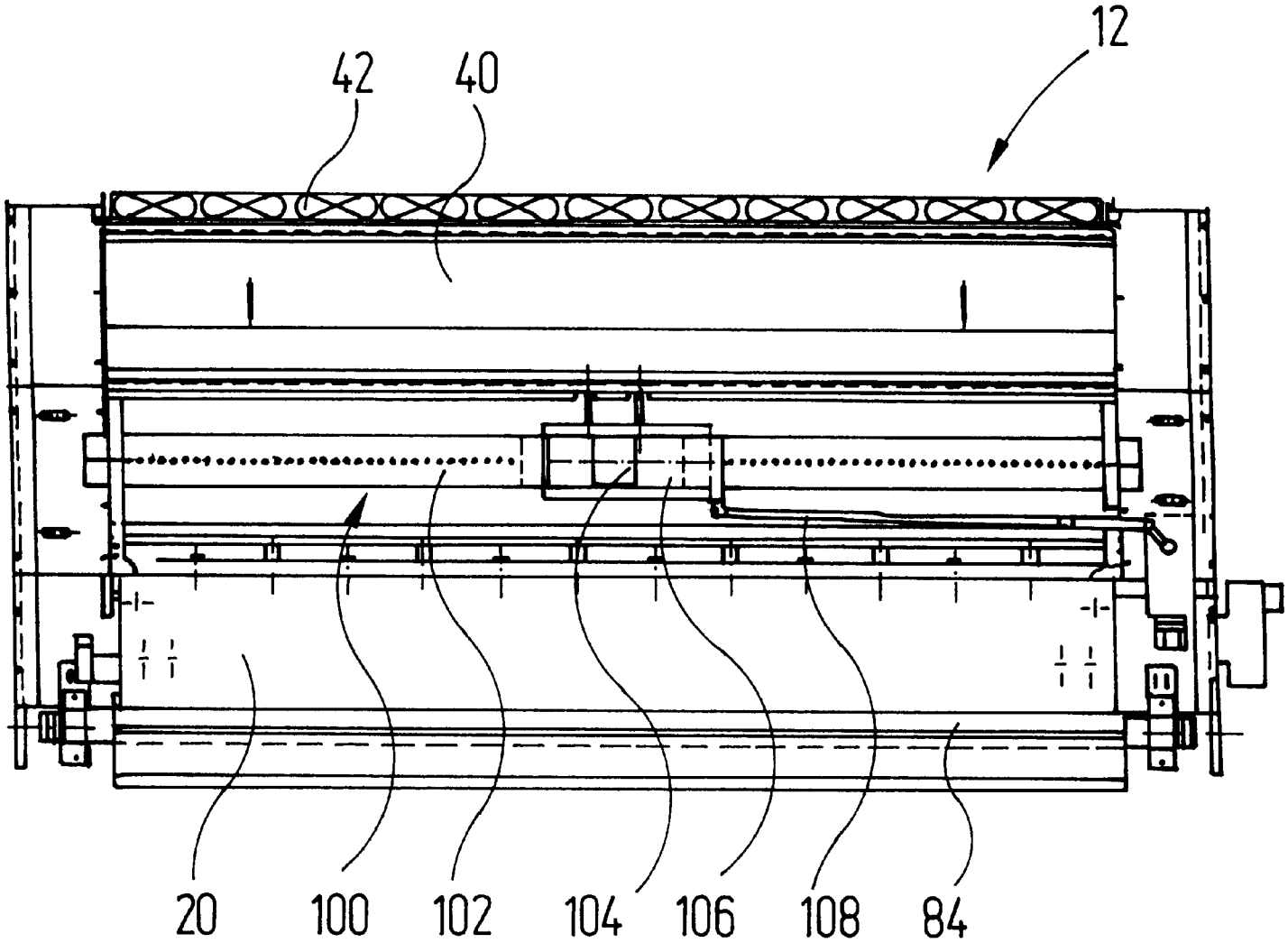
FIG. 5 is a plan view similar to FIG. 4, but on a larger scale of illustration and with the supply and removal devices omitted.

In the exemplary embodiment shown in FIGS. 4 and 5, which is intended for installation in especially confined conditions, compared with the embodiment of FIG. 3 the upstream set of fan wheels 16 has been replaced by a delivery pipe 84, as was described above with reference to FIG. 2. In the downstream region of the dusting box 12, where generally there is more installation space available, the fan wheels 42 still remain, however.

Figure 6:
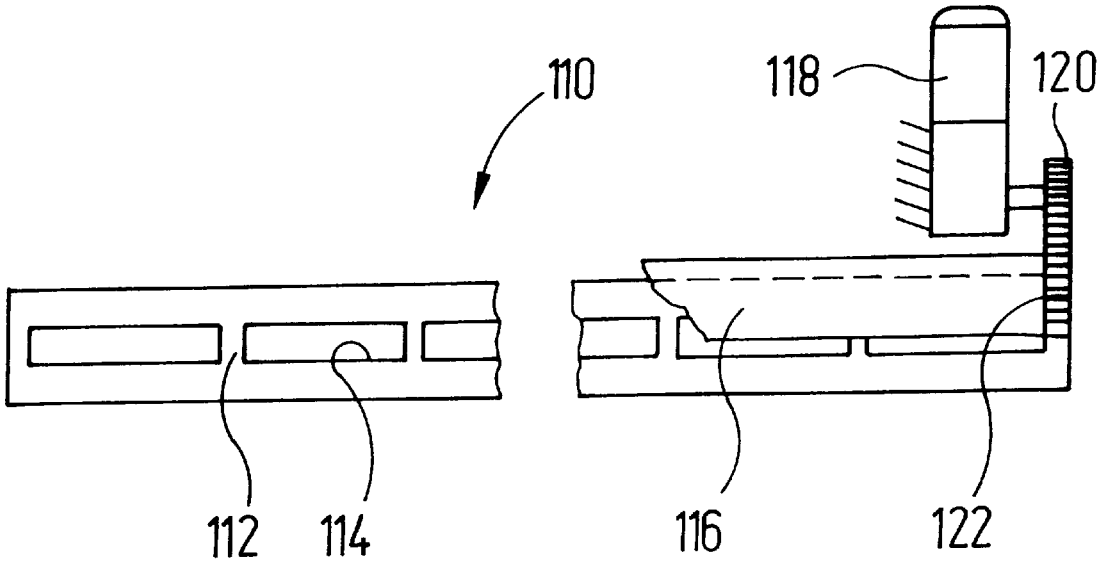
FIG. 6 is a side view of a controllable slotted pipe, which can be used to deliver transport gas or barrier gas or alternatively to extract by suction gas containing unused powder particles.
Figure 7:
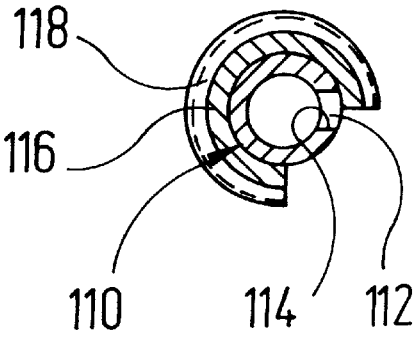
FIG. 7 is a transverse section through the slotted tube shown in FIG. 6.

FIGS. 6 and 7 illustrate a controllable slotted pipe 110. This has a plurality of slots 114 arranged in succession along a surface line and separated only by narrow webs 112; the slots provide a substantially continuous axial slot of relatively large width.

A part-cylindrical slide valve 116, the internal diameter of which corresponds to the external diameter of the slotted pipe, can be rotated in the circumferential direction on the outer surface of the supporting pipe 110.

By turning the slide valve 116 on the slotted pipe 110, the effective extent of the slots 114 in the circumferential direction can be varied, and thus the flow cross-section of the slot 114 can be changed. Movement of the slide valve 116 can be effected, for example, by a servomotor 118, which engages with a pinion 120 in a toothed ring segment 122 carried by the slide valve 116.

The slotted pipe 110 can be used both for delivery of a current of gas and for extracting gas by suction. In both applications, a uniform gas delivery or gas extraction is obtained in the longitudinal direction of the pipe, that is, in a direction transverse to the direction in which the products are conveyed, the strength of the flow passing through the slots 114 being adjustable by rotation of the slide valve 116.

What is claimed is:

1. A method for dusting products comprising the steps of:

a) producing a flow of powder-gas mixture by distributing powder particles in a gas;

b) directing the flow of powder-gas mixture towards a surface of the products moved along a predetermined product conveying surface, and c) directing a flow of transport gas having a speed component tangential to the product conveying surface towards said surface of the products to be dusted, the flow of transport gas spatially overlapping the flow of powder-gas mixture.

2. A method according to claim 1, wherein the flow of powder-gas mixture and the product conveying surface form substantially a right angle with one another.

3. A method according to claim 1, wherein an angular setting between the flow of transport gas and the product conveying surface is between 50° and 60°.

4. A method according to claim 1, wherein the magnitude of the flow of transport gas is adjusted in dependence on the speed at which the products are conveyed.

5. A method according to claim 1, wherein the overlap region between the flow of powder-gas mixture and the flow of transport gas is adjacent to the product conveying surface.

6. A method according to claim 1, further comprising the step of directing a flow of barrier gas having a speed component tangential to the product conveying surface towards said surface of the product, the flow of barrier gas being against the flow of transport gas and lying opposite the flow of transport gas relative to the flow of powder-gas mixture.

7. A method according to claim 6, wherein the flow of transport gas has a tangential component against the direction in which the products are conveyed and is greater than the flow of barrier gas, which has a tangential component in the same direction as the direction in which the products are conveyed.

8. A method according to claim 6, wherein the flow of transport gas has a tangential component running in the direction in which the products are conveyed and is smaller than the flow of barrier gas, which has a tangential component against the direction in which the products are conveyed.

9. A method according to claim 1, further comprising the step of extracting by suction gas from a region which, viewed in the direction in which the products are conveyed, lies downstream of the overlap region of transport gas flow and powder-gas mixture flow.

10. An apparatus for dusting products having:

a) at least one powder-gas mixture delivery means, which extends transverse to a direction in which the products are conveyed, and comprises
   aa) transversely extending powder-gas mixture delivery nozzle means
   bb) a powder-gas mixture generator distributing powder particles in a gas stream and connected to said powder-gas mixture delivery nozzle means,
b) transport gas delivery means, which extends in the width direction transverse to the direction in which the products are conveyed and by which a flow of transport gas having a component tangential to the conveying plane of the products is generated,
c) suction means, the width direction of which runs transverse to the direction in which the products are conveyed and which is connected to an extractor fan, and
d) a housing surrounding the powder-gas mixture delivery means, which housing extends between the transport gas delivery means and said suction means, the working plane of the transport gas delivery means and the working plane of the suction means having a component tangential to the product conveying surface.

11. An apparatus according to claim 10, wherein working planes of the transport gas delivery means and the suction device have substantially opposite and equal angular settings (w) to the product conveying surface.

12. An apparatus according to claim 10, wherein in the working plane pre-set by the powder-gas mixture delivery means, delivery ends of the powder-gas mixture delivery nozzle means have a smaller spacing from the product conveying surface than the working plane of the transport gas delivery means.

13. An apparatus according to claim 10, wherein spaced axially aligned powder-gas mixture delivery nozzles of the powder-gas mixture delivery nozzle means are carried by a powder-gas mixture distributor pipe, delivery ends of the powder-gas mixture delivery nozzles being adjacent to the product conveying surface, whereas the powder-gas mixture distributor pipe lies remote from the product conveying surface.

14. An apparatus according to claim 10, wherein the axis of the powder-gas mixture delivery nozzle means stands perpendicular to the product conveying plane.

15. An apparatus according to claim 13, wherein when viewed in flow direction of the transport gas, the powder-gas mixture distributor pipe is arranged behind hub portions of fan wheels which are arranged side by side in a transverse direction in a transport gas delivery duct.

16. An apparatus according to claim 10, there being a barrier air delivery means arranged between the suction means and the product conveying plane and exposed to the action of a fan, the width direction of the barrier air delivery means running transverse to the direction in which the products are conveyed.

17. An apparatus according to claim 10, wherein walls of the housing which connects the transport gas delivery means to the suction means are made at least partly from microporous material, rear sides thereof being in connection with compressed air chambers.

18. An apparatus according to claim 10, wherein a guide member which is adjacent to the product conveying plane, and in front of which the products pass, extends between the transport gas delivery means and the suction means.

19. An apparatus according to claim 18, the guide member being provided at at least one of upstream and downstream ends, viewed thereof in the direction in which the products are conveyed, with a guide ramp co-operating with product carriers.

20. An apparatus according to claim 18, wherein at an upstream end of the guide member a sealing air delivery means is provided, which generates a current of sealing air directed towards the transport gas delivery means, flowing substantially parallel to the guide member and extending over the width of the suction means.

21. An apparatus according to claim 18, there being provided at a downstream end of the guide member a sealing air delivery means which generates a current of sealing air directed towards the suction means, flowing substantially parallel to the guide member and extending over the width of the transport gas delivery means.

22. An apparatus according to claim 10, wherein at least part of a forming part of said delivery means and suction means fans are controlled by a control unit, according to the speed at which the products are conveyed, for which purpose the control unit is connected on an input side thereof to a speed sensor, which co-operates with product-conveying means.

23. An apparatus according to claim 10, wherein at least one gas delivery nozzle means comprises a distributing pipe carrying a plurality of axially spaced nozzles to which gas is applied from both ends.

24. An apparatus according to claim 10, wherein the suction means comprises a suction pipe, which is connected at both ends to an extractor fan.

25. An apparatus according to claim 10, wherein the suction means comprises a suction pipe transverse to the direction in which the products are conveyed and being connected by way of a powder-separating unit to the inlet of an extractor fan, and the suction pipe comprises a controllable air bypass opening, by means of which it can be connected to ambient atmosphere.

26. An apparatus according to claim 25, wherein the air bypass opening is arranged in a wall region of the suction pipe lying remote from the product conveying plane.

27. An apparatus according to claim 26, wherein the air bypass opening is controllable by two slide valves constrained to move in longitudinal direction of the suction pipe symmetrically with respect to the middle of the suction pipe.

28. An apparatus according to claim 10, wherein a slotted pipe used to deliver or extract gas has an opening extending substantially over its entire axial length, and a slide valve is arranged thereon so as to be circumferentially displaceable on the outer surface of the slotted pipe.

29. An apparatus according to claim 10, wherein the air bypass opening is controllable by a slide valve movable transverse to the longitudinal direction of the suction pipe.

* * * * *